US011293252B2

(12) United States Patent
Lewis et al.

(10) Patent No.: US 11,293,252 B2
(45) Date of Patent: Apr. 5, 2022

(54) FLUID BARRIERS FOR DISSOLVABLE PLUGS

(71) Applicant: Halliburton Energy Services, Inc., Houston, TX (US)

(72) Inventors: Samuel Jason Lewis, The Woodlands, TX (US); Paul Joseph Jones, Houston, TX (US); Lonnie Carl Helms, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 65 days.

(21) Appl. No.: 16/850,440

(22) Filed: Apr. 16, 2020

(65) Prior Publication Data

US 2021/0324701 A1 Oct. 21, 2021

(51) Int. Cl.
*E21B 33/12* (2006.01)
*E21B 29/02* (2006.01)

(52) U.S. Cl.
CPC ..... *E21B 33/12* (2013.01); *E21B 29/02* (2013.01)

(58) Field of Classification Search
CPC ..... E21B 33/12; E21B 29/02
See application file for complete search history.

(56) References Cited

U.S. PATENT DOCUMENTS 5,479,986 A * 1/1996 Gano ..... E21B 23/00 166/292
5,765,641 A * 6/1998 Shy ..... E21B 23/00 166/292
5,826,661 A * 10/1998 Parker ..... E21B 23/00 166/386
6,026,903 A * 2/2000 Shy ..... E21B 23/00 166/192
6,076,600 A * 6/2000 Vick, Jr. ..... E21B 33/1208 166/192
6,161,622 A * 12/2000 Robb ..... E21B 23/00 166/292
7,972,997 B2 7/2011 Svoboda et al.
9,441,437 B2 * 9/2016 Fripp ..... E21B 33/1208
2010/0270031 A1 10/2010 Patel
2011/0042099 A1 * 2/2011 Williamson, Jr. ..... E21B 29/02 166/373
2014/0174757 A1 * 6/2014 Fripp ..... E21B 29/02 166/376
2014/0216756 A1 8/2014 Getzlaf et al.
(Continued)

OTHER PUBLICATIONS

International Search Report and Written Opinion for Application PCT/US2020/029800, dated Jan. 13, 2021.
(Continued)

*Primary Examiner* — Steven A MacDonald
(74) *Attorney, Agent, or Firm* — John Wustenberg; C. Tumey Law Group PLLC

(57) ABSTRACT

Systems, methods, and apparatuses of the present disclosure generally relate to dissolvable plugs for separating fluids in a wellbore. A dissolvable plug includes a first end comprising a first fluid barrier. The first fluid barrier includes a polymer film. The dissolvable plug also includes a second end opposite to the first end. The second end comprises a second fluid barrier. The second fluid barrier comprises a polymer film. The dissolvable plug includes a solid structure made of a sand and salt mixture.

20 Claims, 4 Drawing Sheets

(56) References Cited

U.S. PATENT DOCUMENTS

| | | | | |
|---|---|---|---|---|
| 2014/0338923 | A1* | 11/2014 | Fripp | E21B 33/1208 166/376 |
| 2015/0239795 | A1* | 8/2015 | Doud | C06B 45/18 428/649 |
| 2018/0202260 | A1 | 7/2018 | Getzlaf et al. | |
| 2021/0222507 | A1* | 7/2021 | Vick, Jr. | E21B 33/1208 |
| 2021/0238942 | A1* | 8/2021 | Stratton | E21B 33/1208 |

OTHER PUBLICATIONS

Nine Energy Services—Breakthru Casing Flotation Device, 2020.
NCS Multistage, Well Construction, Airlock Casing Buoyancy System, 2020.
Frank's International, Blackhawk, Casing Flotation Sub, 2020.
TCO, Landmarket Glass Casing Flotation Device (TDP-PO), 2020.
Halliburton, Kevin Ardoin, Cementing—BACE, Using buoyancy-assisted casing equipment to extend lateral reach, Oct. 2017.

* cited by examiner

FLUID BARRIERS FOR DISSOLVABLE PLUGS

BACKGROUND

In horizontal or deviated wells, drag forces may hinder casing from reaching total depth (TD) by exceeding a hook load or a casing buckling capacity. In order to reduce the drag forces, the casing in a horizontal or deviated section may be filled with air or a lightweight fluid for buoyancy. After the casing reaches TD, a rupture disc is burst, and the air or lightweight fluid chamber is filled with fluid.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1B:
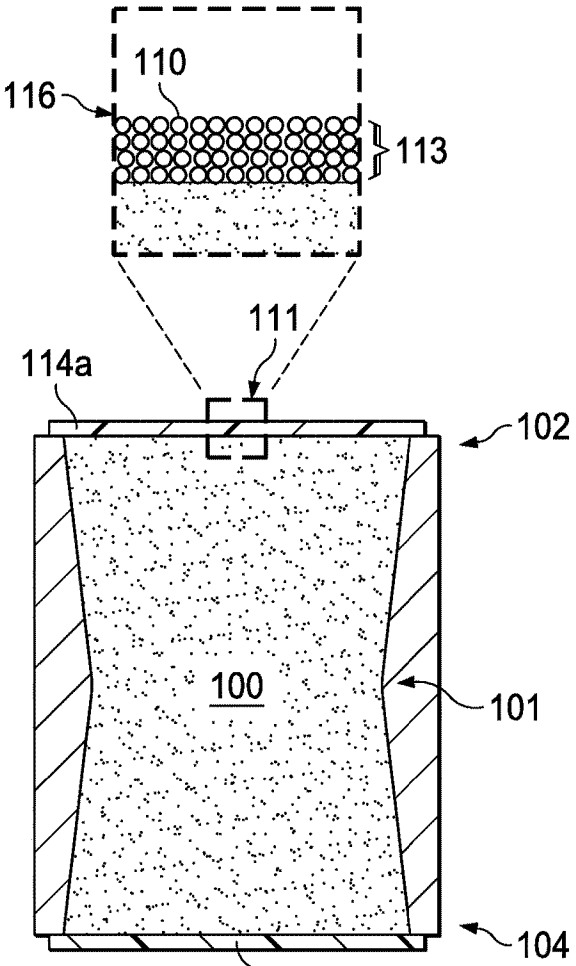
FIGS. 1A and 1B illustrate an exemplary process that procures a fluid barrier on opposing ends of a dissolvable salt plug, in accordance with examples of the present disclosure.

The present disclosure relates to dissolvable salt plugs that may be utilized to separate fluids within a wellbore. Specifically, systems, methods, and apparatuses of the present disclosure may utilize dissolvable salt plugs that include a film deposited from an emulsion of rubber in water. The film may provide a layer that provides a fluid barrier that is impenetrable by downhole fluids. The film may prevent dissolution of the dissolvable salt plug, as the dissolvable salt plug is run in hole ("RIH") or disposed in the wellbore.

In certain examples, the dissolvable salt plugs may be utilized with a buoyancy assisted casing tool. The dissolvable salt plug may provide a barrier between a fluid disposed up-hole to the dissolvable salt plug and a lightweight fluid contained in a buoyancy chamber, of the buoyancy assisted casing tool, that is disposed downhole from the dissolvable salt plug. The buoyancy assisted casing tool may be attached to the casing string at a surface of a wellbore before the buoyancy assisted casing tool is moved downhole within a subterranean formation. The fluid disposed up-hole to the dissolvable salt plug may include various fluids utilized for downhole operations in the oilfield. Non-limiting examples of the various fluids include drilling fluids, cement compositions, fresh water, brine, chemical additives, or combinations thereof. The drilling fluids may include oil-based muds or water-based muds, for example.

The lightweight fluid contained within the buoyancy chamber downhole to or below the dissolvable salt plug may have a density that is less than the fluid disposed up-hole to the dissolvable salt plug. Non-limiting examples of the lightweight fluid may include nitrogen, carbon dioxide, air, or combinations thereof.

The dissolvable salt plug contains or seals the lightweight fluid within the buoyancy chamber created by the buoyancy assisted casing tool until TD or a desired depth. At TD, a rupture disc of the buoyancy assisted casing tool may be burst, thereby allowing the dissolvable salt plug to dissolve. Removal of the salt plug releases the lightweight fluid from the buoyancy chamber and allows the buoyancy chamber to fill with the fluid that is disposed up-hole to the dissolvable salt plug. Filling of the buoyancy chamber enables the casing to be prepared for cementing operations.

The films of the present disclosure may replace polyisoprene elastomer diaphragms that may protect (e.g., encompass) a downhole plug as the downhole plug is moved into a wellbore. The polyisoprene elastomer diaphragms may prevent premature dissolution of the dissolvable salt plug. However, the polyisoprene elastomer diaphragms may travel to a float collar or float shoe during RIH and may become trapped in a poppet valve thereof which may hinder fluid flow through the poppet valve (e.g., prevents closure of the valve).

By replacing the polyisoprene elastomer diaphragms with films deposited from an emulsion of rubber in water, the amount of elastomer in the buoyancy assisted casing tool is substantially reduced, as well as risk to the float equipment. Upon contact of the emulsion with the salt surface of the dissolvable salt plug, the rubber instantaneously precipitates on the salt surface. As a solvent of the emulsion evaporates, a film is formed or produced on the contacted salt surface.

The film provides a fluid barrier that is impenetrable by downhole fluids. A thickness of the film may be substantially thinner than the elastomeric diaphragms resulting in less residual polymer debris downhole. A thinner coating of the film produces less debris and reduces the risk of interference with the float equipment operation. Upon dissolution of the salt of the dissolvable salt plug, the film disintegrates. In certain examples, the film be applied by brushing, pouring, or spraying the emulsion onto opposing ends of the dissolvable salt plug. Film thickness may be controlled by applying subsequent layers. The film may be applied to one, both or multiple surfaces that may contact fluids. In some examples, an additional fluid barrier may be fastened to the film by a press-fit, for example.

Figure 1A:
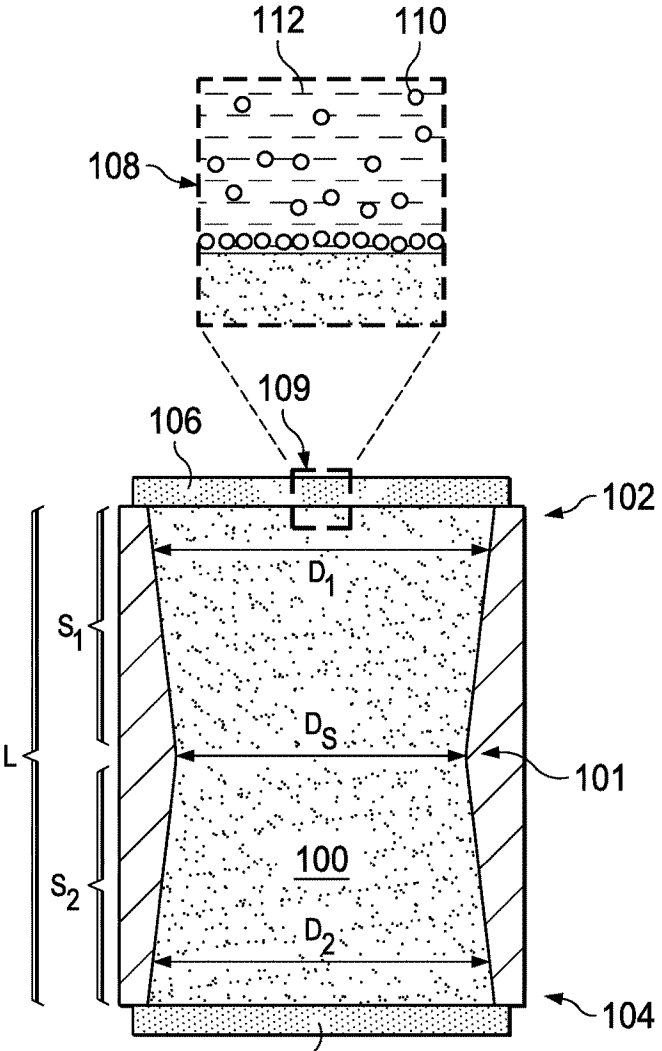

FIGS. 1A and 1B illustrate an exemplary process that procures a film on opposing ends of a dissolvable salt plug 100 in accordance with examples of the present disclosure. Lateral cross-sectional views of the dissolvable salt plug 100 are illustrated in FIGS. 1A and 1B, for example.

The dissolvable salt plug 100 may be a solid structure or matrix that may include sand and salt, for example. Types of salt included in the dissolvable salt plug 100 may include alkali metal halides and/or alkaline earth metal halides. Specific examples may include, but are not limited to, sodium chloride, potassium chloride, magnesium chloride, calcium chloride, or combinations thereof. The dissolvable salt plug 100 may be made from the salt, water, and sand that are mixed and cured at high temperatures and pressures to form a solid unitary and rigid structure or matrix that may withstand pressures ranging from 9,000 pounds per square inch ("psi") (62,053 kilopascals ("kPa") to 10,000 psi (68, 948 kPa).

As shown on FIG. 1A, the diameter of the dissolvable salt plug 100 may vary along a length, L, of the dissolvable salt plug 100. In certain examples, the dissolvable salt plug 100 may include a circumferential tapered section 101 including sections $S_1$ and $S_2$, each of which extends around or about a circumference and along a length, L, of the dissolvable salt plug 100. The dissolvable salt plug 100 may include a first circumference or diameter, $D_1$, at a first end or up-hole portion 102 (oriented in an up-hole direction), and a second circumference or diameter, $D_2$, at a second opposing end or downhole portion 104 (oriented in a downhole direction). $D_1$ may be equal to $D_2$. The diameter of the dissolvable salt plug 100 may decrease from $D_1$ to the smallest diameter, $D_s$, and increase from $D_s$ to $D_2$, along L of the dissolvable salt plug 100, as shown. $S_1$ may extend from $D_1$ to $D_s$. $S_2$ may extend from $D_s$ to $D_2$.

The diameters of the dissolvable salt plug 100 may correspond with various casing diameters. The diameters may range from about 3 inches (8 cm) to about 9 inches (23 centimeters (cm). For example, the diameters may include 3.5 inches (9 cm), 4.5 inches (11 cm), 5.5 inches (14 cm), or 7 inches (18 cm). Lengths for the dissolvable salt plug 100 may range from about 4 inches (10 cm) to about 8 inches (20 cm), for example.

At least a portion of the dissolvable salt plug 100 may contact an emulsion 106. For example, the up-hole portion 102 and the downhole portion 104 of the dissolvable salt plug 100 may be treated with the emulsion 106. The up-hole portion 102 may be positioned opposite to the downhole portion 104. The up-hole portion 102 may be similar to the downhole portion 104. As shown on a close-up view 108 of a portion 109 of the emulsion 106, the emulsion 106 may be an emulsion of rubber in water. For example, the emulsion 106 may include polymer particles 110 which may be present in a latex solution 112. Upon contact of the emulsion 106 with the up-hole portion 102 and the downhole portion 104 of the dissolvable salt plug 100, the rubber (e.g., the polymer particles 110) instantaneously precipitates on and adheres to the up-hole portion 102 and the downhole portion 104.

As shown on FIG. 1B, the latex solution 112 (e.g., a solvent) may evaporate thereby leaving films 114*a* and 114*b* on the up-hole portion 102 and the downhole portion 104 of the dissolvable salt plug 100. The films 114*a* and 114*b* may be polymer films made of the polymer particles 110. The film 114*a* may be similar to the film 114*b*. Specific examples of suitable polymer films may include, but are not limited to, styrene-butadiene copolymer, acrylonitrile-butadiene styrene copolymer, isobutylene, polyisoprene, polyvinyl alcohol, polyacrylate, or combinations thereof. The polymers by be crosslinked or not crosslinked.

As illustrated in a close-up view 116 of a portion 111 of the film 114*a*, the film 114*a* may include interconnected layers 113 of the polymer particles 110, in some examples. That is, a layer 113 (e.g., 2-10 layers) may be added as needed. The films 114*a* and 114*b* may each have a thickness of 0.1 millimeter ("mm") through 2 mm, in certain examples. In other examples, the films 114*a* and 114*b* may each have a thickness of 0.5 mm to 10 mm or 0.1 mm to 2 mm. The films 114*a* and 114*b* may attach or adhere to and completely cover the up-hole portion 102 and the downhole portion 104 of the dissolvable salt plug 100, respectively. The films 114*a* and 114*b* may provide impenetrable seals (e.g., fluid barriers) that prevent fluid (e.g., a drilling fluid, water) from penetrating the dissolvable salt plug 100 from the up-hole portion 102 (e.g., fluid penetration from an up-hole direction) and the downhole portion 104 (e.g., fluid penetration from a downhole direction) of the salt plug 100. In some examples, the dissolvable salt plug 100 may only be dissolvable upon contacting the circumferential tapered section 101 with fresh water (e.g., water with less than 500 parts per million ("ppm") of dissolved salts). That is, the circumferential tapered section 101 may be a section of the salt plug 100 that receives the fresh water for dissolution of the dissolvable salt plug 100. As the salt plug 100 is dissolved, the films 114*a* and 114*b* disintegrate. In certain examples, an additional fluid barrier may be placed over each of the films 114*a* and/or 114*b* to assist with sealing and to distribute any fluid pressure received over the films 114*a* and/or 114*b* to prevent any damage to the films 114*a* and/or 114*b*.

Figure 2:
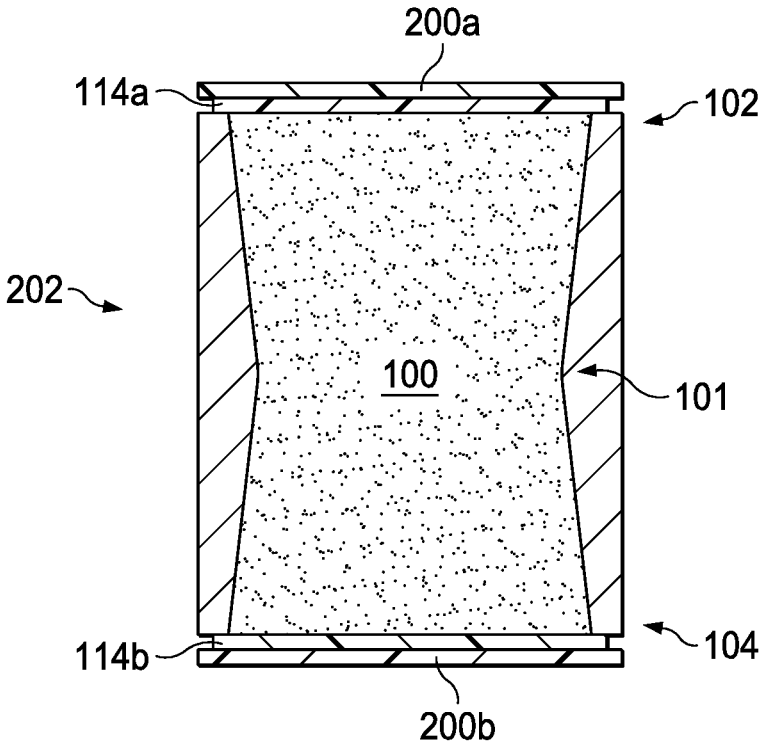
FIG. 2 illustrates additional fluid barriers placed on opposing ends of the dissolvable salt plug, in accordance with examples of the present disclosure.

FIG. 2 illustrates additional barriers 200*a* and 200*b* attached to the film 114*a* and the film 114*b* of the dissolvable salt plug 100, in accordance with examples of the present disclosure. Each of the barriers 200*a* and 200*b* may include a rubber (e.g., a polymer) that is placed over and adjacent to the films 114*a* and 114*b* to assist with sealing the up-hole portion 102 and the downhole portion 104 of the dissolvable salt plug 100. The barriers 200*a* and 200*b* may be fluid barriers with a thickness less than 1 mm, for example. The barriers 200*a* and 200*b* may be press-fitted onto the up-hole portion 102 and the downhole portion 104. The barriers 200*a* and 200*b* may completely cover the films 114*a* and 114*b*. As noted above, the barriers 200*a* and 200*b* may be placed over the films 114*a* and 114*b* to assist with sealing the dissolvable salt plug 100 from fluid present in the up-hole and downhole directions of a wellbore (e.g., the wellbore 302 shown on FIG. 3).

The barriers 200*a* and 200*b* may also distribute any fluid pressure received or exerted over the films 114*a* and 114*b* to prevent any damage to the films 114*a* and 114*b*. For example, the dissolvable salt plug 100 may be pressurized by a column of fluid within a wellbore during RIH. Further, the dissolvable salt plug 100 may be displacing a fluid (e.g., a drilling fluid) in the wellbore which may also exert fluid pressure against the film 114*b*. After dissolution of the dissolvable salt plug 100, the barriers 200*a* and 200*b* may collapse and be circulated out of the wellbore.

In some examples, the dissolvable salt plug 100 may be disposed within a seat 202 of a downhole tool. A shape or profile of the seat 202 may correspond to a shape or profile of the dissolvable salt plug 100 (including the circumferential tapered section 101) to ensure a snug fit between the seat 202 and the dissolvable salt plug 100.

Figure 3:
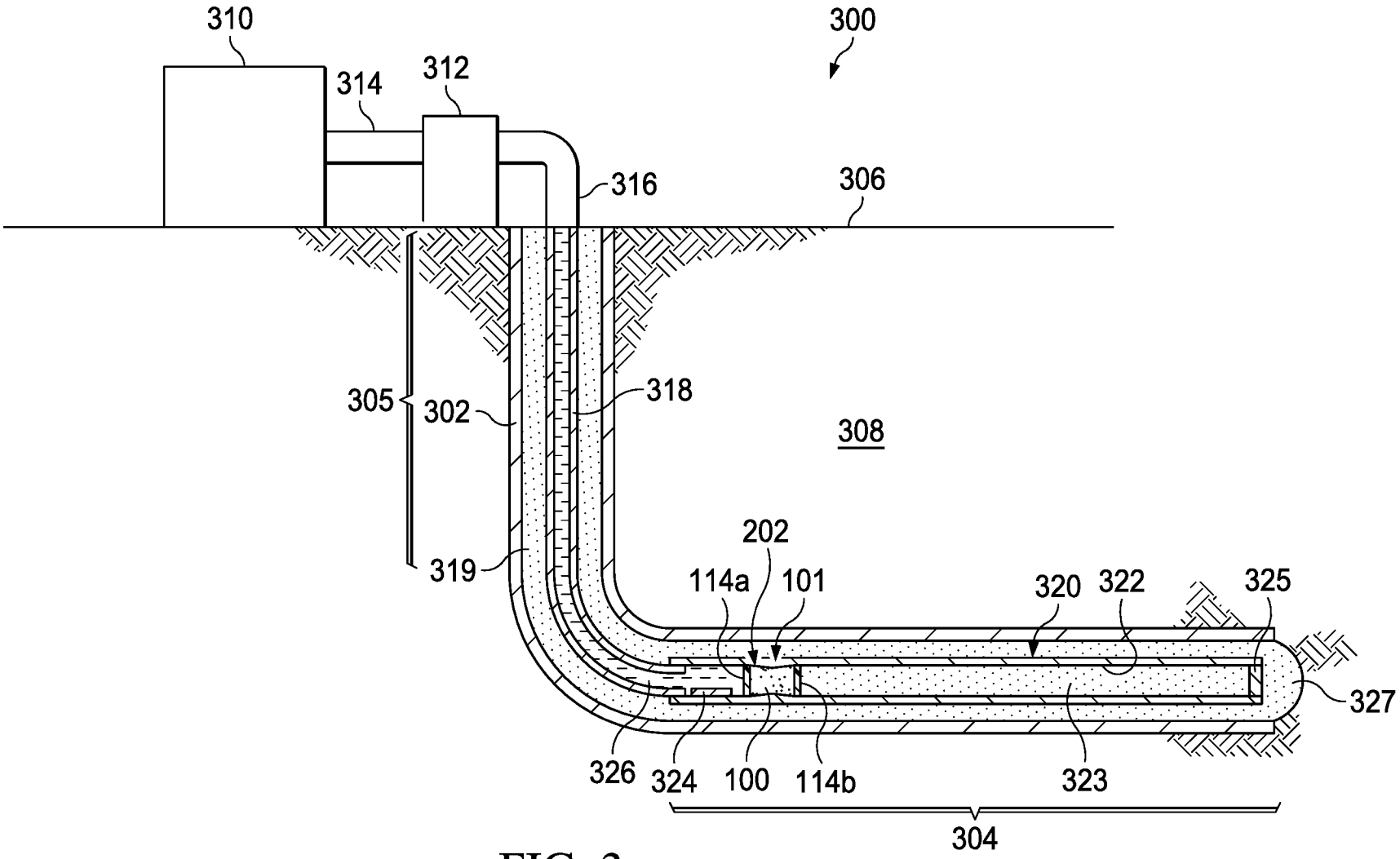
FIG. 3 illustrates a system implementing the dissolvable salt plug, in accordance with examples of the present disclosure.

FIG. 3 illustrates a system 300 comprising the dissolvable salt plug 100 in accordance with examples of the present disclosure. In some examples, the system 300 may be located at a well site. A wellbore 302 (e.g., a wellbore drilled for hydrocarbon recovery) may extend from a surface 306 into a subterranean formation 308. The wellbore 302 may include a horizontal or deviated section 304. The section 304 may be angled or may deviate more than 10° from a vertical section 305 of the wellbore 302. Although illustrated onshore, the wellbore 302 may be located offshore in certain examples. The wellbore 302 may be fluidly coupled to surface equipment such as a pump 310 and fluid storage 312 via conduits 314 and 316, for example. The fluid storage 312 (e.g., a container or pit) may store various fluids such as fresh water, brine, cement compositions, drilling fluids, or chemical additives, that may be pumped downhole, for example. Although not illustrated, the system 300 may also include other equipment utilized at a well site to at least assemble, disassemble, or move various components and/or materials into and out of the wellbore 302, as should be understood by one of skill in the art, with the benefit of this disclosure.

Casing string 318 may be disposed within the wellbore 302. An annulus 319 may be defined between the casing string 318 and the wellbore 302. A tool 320 (e.g., a downhole tubular connected via threads to the casing string 318) may be a section of the casing string 318. The tool 320 may be a buoyancy assisted casing tool. At the surface 306, the casing string may be made up with the tool 320 before the casing string 318 is moved into the wellbore 302. The tool 320 may be exposed to the wellbore 302 (i.e., the casing 318 does not cover the tool 320).

The tool 320 may create a buoyancy chamber 322 which may be sealed between the dissolvable salt plug 100 and a float shoe or float collar 325, for example. The dissolvable salt plug 100 may be positioned within the seat 202 of the tool 320. The buoyancy chamber 322 may be filled with a fluid 323. The fluid 323 may include a gas such as nitrogen, carbon dioxide, or air, for example. The buoyancy chamber 322 may be disposed down-hole from the salt plug 100 and may be filled with fluid that has a lower specific gravity than fluid in the wellbore 302 in which the tool 320 and the casing string 318 is run. Buoyancy of the buoyancy chamber 322 may be adjusted via selection of a specific fluid or an amount of that specific fluid contained within the buoyancy chamber 322, for example.

The films 114*a* and 114*b* of the dissolvable salt plug 100 provide fluid barriers to separate the fluid 323 of the tool 320 from a fluid 326 disposed up-hole to the dissolvable salt plug 100. The film 114*a* may contact the fluid 326 and the film 114*b* may contact the fluid 323. The fluid 326 may have a density or specific gravity that is greater than a density or specific gravity of the fluid 323. The fluid 326 may include various fluids, such as fresh water, brine, cement compositions, drilling fluids, or chemical additives, that may be pumped downhole, for example.

The tool 320 may also include a rupture disc 324 positioned adjacent or in close proximity to the dissolvable salt plug 100. The rupture disc 324 may be made of metal and may be in fluid communication with the fluid 326. The rupture disc 324 may have a rupture pressure greater than the hydraulic pressure encountered by the casing string 318 as the casing string 318 is RIH (e.g., run into the wellbore 302), in order to prevent premature bursting of the rupture disc 324. The rupture disc 324 may withstand pressures ranging from 5,000 psi through 40,000 psi, for example.

As noted above, the casing string 318 may be made up at the surface 306 to include the tool 320. That is, the tool 320 is in an interconnected (connecting end to end via threads) series of individual tubulars of the casing string 318. After connecting the tool 320 to the casing string 318, the casing string 318 and the tool 320 are run into the wellbore 302 until friction drag on the casing string 318 caused by a wellbore fluid 327 and/or walls of the wellbore 302, prevents the casing string 318 from moving any further downhole within the wellbore 302 or until the desired depth for the casing has been achieved. The wellbore fluid 327 may include fluid similar to that of the fluid 326. After progressive movement of the casing string ceases, circulating equipment at the surface 306 such as the pump 312 may circulate the fluid 326 through the casing string 318 such that the rupture disc 324 bursts. Bursting of the rupture disc 324 may allow fresh water to contact the circumferential tapered section 101 thereby releasing the dissolvable salt plug 100. Once the dissolvable salt plug 100 is removed, the fluid above or up-hole to the dissolvable salt plug 100 is released to displace the lightweight fluid or gas from below or downhole to the dissolvable salt plug 100. The lightweight material can either percolate within the casing string 318 to the surface 306 or be circulated outside the casing string 318 into the annulus 319 to be displaced to the surface 306.

Figure 4:
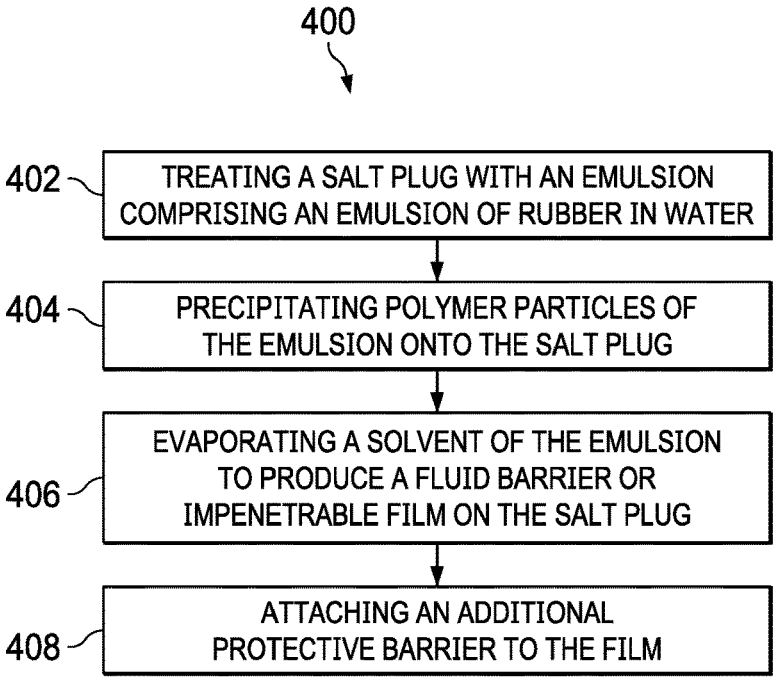
FIG. 4 illustrates a flow chart for forming fluid barriers on opposing ends of the dissolvable salt plug, in accordance with examples of the present disclosure.

FIG. 4 illustrates a flow chart 400 for treating a salt plug with an emulsion to form an impenetrable film or fluid barrier on opposing ends of the salt plug in accordance with examples of the present disclosure. At step 402, opposing ends of a salt plug (e.g., the up-hole portion 102 and the downhole portion 104 of the dissolvable salt plug 100 shown on FIGS. 1A, 1B, and 2) may be treated with an emulsion of rubber in water (e.g., the emulsion 106). The emulsion 106 may be applied, as at least one layer, to the up-hole portion 102 and the downhole portion 104 by brushing, pouring, or spraying the emulsion 106 onto a surface of the up-hole portion 102 and the downhole portion 104.

At step 404, upon contacting the emulsion 106 with a salt surface of the up-hole portion 102 and/or the downhole portion 104 of the dissolvable salt plug 100, polymer particles (e.g., the polymer particles 110 shown on FIGS. 1A and 1B) of the emulsion 106 may precipitate onto the up-hole portion 102 and the downhole portion 104 of the dissolvable salt plug 100 to completely cover each end of the dissolvable salt plug 100.

At step 406, after precipitation of the polymer particles 110, a solvent of the emulsion 106 (e.g., the latex solution 112 shown on FIG. 1A) may evaporate (e.g., due to ambient conditions or a dryer/heater), thereby producing impenetrable seals or fluid barriers comprising films (e.g., the films 114*a* and 114*b* shown on FIGS. 1B and 2) on the up-hole portion 102 and the downhole portion 104 of the dissolvable salt plug 100. Multiple layers (e.g., 2-10 layers) of the emulsion 106 may be applied to the films 114*a* and 114*b*, as desired, to provide increasing layers of sealing protection (e.g., the layers 113 shown on FIG. 1B).

At step 408, an additional rubber barrier (e.g., the barriers 200*a* and 200*b*) may be positioned (e.g., press fitted) over the films 114*a* and 114*b* to protect the films.

Figure 5:
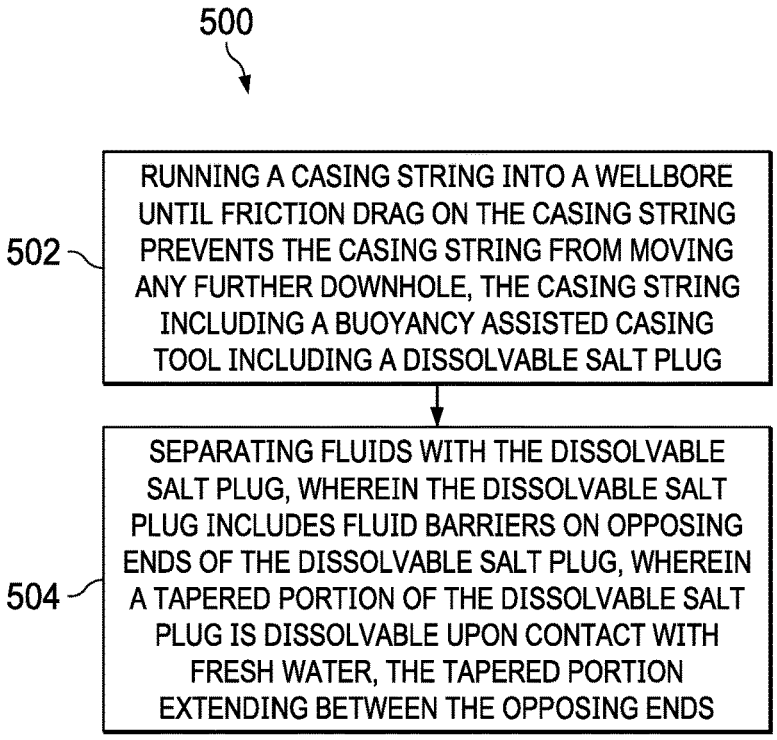
FIG. 5 illustrates a flow chart for separating fluids in a subterranean formation with a dissolvable salt plug, in accordance with examples of the present disclosure.

FIG. 5 illustrates a flow chart 500 for separating fluids in the subterranean formation 308 with the dissolvable salt plug 100, in accordance with examples of the present disclosure. At step 502, a casing string (e.g., the casing string 318 shown on FIG. 3) is run into a wellbore (e.g., the wellbore 302 shown on FIG. 3) until friction drag on the casing string 318 caused by fluid (e.g., drilling fluid) and/or walls of the wellbore 302 prevents the casing string 318 from moving any further downhole within the wellbore 302 (i.e., the casing string 318 has landed (e.g., TD has been reached) within the wellbore 302). The casing string 318 may include the tool 320 comprising the buoyancy chamber 322 sealed with the dissolvable salt plug 100 (e.g., shown on FIG. 3).

At step 504, the dissolvable salt plug 100 separates an up-hole fluid such as the fluid 326 shown on FIG. 3 from a lightweight fluid contained in the tool 320 such as the fluid 323 also shown on FIG. 3. The dissolvable salt plug 100 may include fluid barriers or the films 114*a* and 114*b* disposed on opposing ends, and thus may only dissolve upon the circumferential tapered portion 101 contacting fresh water, as best shown on FIG. 2.

To facilitate understanding of various aspects of the present disclosure, the following example is provided.

EXAMPLE

To evaluate the effectiveness of the latex coating, a core with a 1-inch (2.54 cm) diameter and a length of approximately 2 inches (5.08 cm), was taken from a sand/salt plug. The core was placed in a Hassler sleeve. A 1 mm to 2 mm latex coating was applied to a top surface of the core. After drying the film, 150 psi (1034 kPa) of pressure was applied to the film with water. No penetration was observed over a time period of 1 week. The temperature of the test assembly was increased to 150° F. (65.6° C.), and again no leakage was observed after 24 hours.

Accordingly, the present disclosure may provide systems, methods, and apparatuses that may utilize dissolvable salt plugs with a film deposited from an emulsion of rubber in water. The systems, methods, and apparatus may include any of the various features disclosed herein, including one or more of the following statements.

Statement 1. A dissolvable plug comprising: a first end comprising a first fluid barrier, the first fluid barrier comprising a polymer film; and a second end opposite to the first end, the second end comprising a second fluid barrier, the second fluid barrier comprising a polymer film; wherein the dissolvable plug comprises a solid structure made of a sand and salt mixture.

Statement 2. The dissolvable plug of the statement 1, wherein a tapered section extends from the first end to the second end, wherein the tapered section does not comprise any fluid barrier.

Statement 3. The dissolvable plug of the statement 2, further comprising an additional fluid barrier disposed on each of the first and second fluid barrier.

Statement 4. The dissolvable plug of the statement 3, wherein the additional fluid barrier comprises a rubber.

Statement 5. The dissolvable plug of any of the preceding statements, wherein a sand of the sand and salt mixture comprises alkali metal halides or alkaline earth metal halides.

Statement 6. The dissolvable plug of any of the preceding statements, wherein the dissolvable plug comprises sodium chloride, potassium chloride, magnesium chloride, calcium chloride, or combinations thereof.

Statement 7. The dissolvable plug of any of the preceding statements, wherein a length of the dissolvable plug ranges from 4 inches to 8 inches.

Statement 8. A system for separating fluids in a wellbore, the system comprising: a dissolvable plug comprising: a first end comprising a first fluid barrier, the first fluid barrier comprising a polymer film; and a second end opposite to the first end, the second end comprising a second fluid barrier, the second fluid barrier comprising a polymer film; wherein the plug comprises a solid structure made of a sand and salt mixture; and casing extending in a direction that deviates at least 10° from a vertical direction, the dissolvable plug positioned in the casing.

Statement 9. The system of the statement 8, wherein a deviated section of the casing comprises a buoyancy assisted casing tool comprising a buoyancy chamber.

Statement 10. The system of the statement 9, wherein the dissolvable plug separates a first fluid from a second fluid, wherein the first fluid is up-hole from the dissolvable plug, wherein the second fluid is downhole from the dissolvable plug.

Statement 11. The system of the statement 10, wherein the first fluid is different from the second fluid.

Statement 12. The system of the statement 11, wherein the first fluid has a specific gravity that is greater than a specific gravity of the second fluid.

Statement 13. The system of the statement 12, wherein the second fluid is disposed in the buoyancy chamber.

Statement 14. The system of any of the statements 8-13, wherein the second fluid comprises nitrogen, carbon dioxide, or air.

Statement 15. A method for producing at least one fluid barrier on a salt plug, the method comprising: contacting a first end of the salt plug with an emulsion of rubber in water; evaporating a solvent of the emulsion; and forming at least one layer of polymer particles on the first end to protect the first end from fluid penetration.

Statement 16. The method of the statement 15, further comprising contacting a second end of the salt plug with the emulsion of rubber in water, the second end opposite from the first end; evaporating the solvent of the emulsion; and forming a second layer of polymer particles on the first end to protect the first end from fluid penetration.

Statement 17. The method of the statement 15 or the statement 16, wherein contacting the first and second ends of the salt plug comprises contacting the first and second ends of the salt plug with a latex solution comprising the polymer particles.

Statement 18. The method of any of the statements 15-17, wherein evaporating the solvent comprises evaporating a latex solution.

Statement 19. The method of any of the statements 15-18, further comprising disposing an additional fluid barrier on the at least one layer of polymer particles.

Statement 20. The method of any of the statements 15-19, further comprising disposing an additional fluid barrier on the second layer of polymer particles.

It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces. The term "coupled" means directly or indirectly connected.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A dissolvable plug comprising:

a first end comprising a first fluid barrier, the first fluid barrier comprising a polymer film comprising polymer particles precipitated from an emulsion; and a second end opposite to the first end, the second end comprising a second fluid barrier, the second fluid barrier comprising a second polymer film;

wherein the dissolvable plug comprises a solid structure made of a sand and salt mixture.

2. The dissolvable plug of claim 1, wherein a tapered section extends from the first end to the second end, wherein the tapered section does not comprise any fluid barrier.

3. The dissolvable plug of claim 2, further comprising an additional fluid barrier disposed on each of the first and second fluid barrier.

4. The dissolvable plug of claim 3, wherein the additional fluid barrier comprises a rubber.

5. The dissolvable plug of claim 1, wherein a sand of the sand and salt mixture comprises alkali metal halides or alkaline earth metal halides.

6. The dissolvable plug of claim 5, wherein a length of the dissolvable plug ranges from 4 inches to 8 inches.

7. The dissolvable plug of claim 1, wherein the dissolvable plug comprises sodium chloride, potassium chloride, magnesium chloride, calcium chloride, or combinations thereof.

8. The dissolvable plug of claim 1, wherein the polymer film comprises styrene-butadiene copolymer, acrylonitrile butadiene, styrene copolymer, isobutylene, polyisoprene, polyvinyl alcohol, polyacrylate, or combinations thereof.

9. The dissolvable plug of claim 1, wherein a thickness of the polymer film ranges from 0.1 mm to 10 mm.

10. A dissolvable plug comprising:

a first end comprising a first fluid barrier, the first fluid barrier comprising a polymer film comprising polymer particles precipitated from an emulsion; and a second end opposite to the first end, the second end comprising a second fluid barrier, the second fluid barrier comprising a second polymer film;

a first diameter at the first end;

a second diameter at the second end;

a third diameter disposed between the first end and the second end;

an additional fluid barrier disposed on each of the first and second fluid barrier;

wherein the dissolvable plug comprises a solid structure made of a sand and salt mixture.

11. The dissolvable plug of claim 10, wherein the third diameter disposed between the first end and the second end is smaller than the first diameter at the first end and the second diameter at the second end.

12. The dissolvable plug of claim 10, wherein the third diameter disposed between the first end and the second end is not smaller than the first diameter at the first end and the second diameter at the second end.

13. The dissolvable plug of claim 10, wherein the additional fluid barrier comprises a rubber.

14. The dissolvable plug of claim 10, wherein the thickness of the polymer film ranges from about 0.1 mm to about 10 mm.

15. The dissolvable plug of claim 10, wherein a sand of the sand and salt mixture comprises alkali metal halides or alkaline earth metal halides.

16. The dissolvable plug of claim 10, wherein the dissolvable plug comprises sodium chloride, potassium chloride, magnesium chloride, calcium chloride, or combinations thereof.

17. The dissolvable plug of claim 10, wherein the polymer film comprises styrene-butadiene copolymer, acrylonitrile butadiene, styrene copolymer, isobutylene, polyisoprene, polyvinyl alcohol, polyacrylate, or combinations thereof.

18. A dissolvable plug comprising:

a first end comprising a first fluid barrier, the first fluid barrier comprising a polymer film comprising polymer particles precipitated from an emulsion; and a second end opposite to the first end, the second end comprising a second fluid barrier, the second fluid barrier comprising a second polymer film;

a first diameter at the first end;

a second diameter at the second end;

a third diameter disposed between the first end and the second end;

wherein the third diameter disposed between the first end and the second end is smaller than the first diameter at the first end and the second diameter at the second end;

wherein the dissolvable plug comprises a solid structure made of a sand and salt mixture; and wherein the polymer film comprises styrene-butadiene copolymer, acrylonitrile butadiene, styrene copolymer, isobutylene, polyisoprene, polyvinyl alcohol, polyacrylate, or combinations thereof.

19. The dissolvable plug of claim 18, further comprising an additional fluid barrier disposed on each of the first and second fluid barriers.

20. The dissolvable plug of claim 19, wherein the additional fluid barrier comprises a rubber.

* * * * *